US005249318A

United States Patent [19]

Loadsman

[11] Patent Number: 5,249,318

[45] Date of Patent: Oct. 5, 1993

[54] AIR SUPPORT CUSHION

[76] Inventor: Gerald H. Loadsman, 13122 St. Thomas Dr., Santa Ana, Calif. 92705

[21] Appl. No.: 895,570

[22] Filed: Jun. 5, 1992

Related U.S. Application Data

[63] Continuation of Ser. No. 198,142, May 24, 1988, abandoned.

[51] Int. Cl.[5] ..... A47C 27/10; A47C 7/04

[52] U.S. Cl. ..... 5/453; 5/423; 5/469; 5/461; 5/465

[58] Field of Search ..... 5/421, 423, 468, 469, 5/449, 453, 461, 455, 465, 473

[56] References Cited

U.S. PATENT DOCUMENTS

| | | | |
|---|---|---|---|
| 2,998,817 | 9/1961 | Armstrong | 5/469 |
| 3,446,203 | 5/1969 | Murray | 5/453 |
| 3,778,851 | 12/1973 | Howortn | 5/423 |
| 3,822,425 | 7/1974 | Scales | 5/469 |
| 3,909,858 | 10/1975 | Ducker . | |
| 4,136,413 | 1/1979 | Scales | 5/423 |
| 4,149,285 | 4/1979 | Stanton . | |
| 4,225,989 | 10/1980 | Corbett et al. | 5/469 |
| 4,267,611 | 5/1981 | Agulnick | 5/469 |
| 4,347,633 | 9/1982 | Gammons et al. . | |
| 4,394,784 | 7/1983 | Swenson et al. . | |
| 4,488,322 | 12/1984 | Hunt et al. | 5/455 |
| 4,525,885 | 7/1985 | Hunt et al. | 5/455 |
| 4,542,547 | 9/1985 | Sato . | |
| 4,644,597 | 2/1987 | Walker | 5/453 |
| 4,745,647 | 5/1988 | Goodwin | 5/467 |
| 4,768,249 | 7/1988 | Goodwin | 5/453 |

FOREIGN PATENT DOCUMENTS

| | | | |
|---|---|---|---|
| 2164278 | 7/1973 | Fed. Rep. of Germany | 5/469 |
| 2274251 | 1/1976 | France | 4/455 |
| 2582938 | 12/1986 | France | 5/453 |
| 1545806 | 5/1979 | United Kingdom | 5/455 |

OTHER PUBLICATIONS

Advertisement: Flexicair II: Low Airloss Therapy.
Advertisement: "Pressure Menas Pain . . . " Kinetic Concept's brochure advertising the Kinair System.
Advertisement: "Clinitron Therapy . . . ", SSI's one page advertisment of the Clinitron bed.
Advertisement: *Health Care System*, Jun., 1986, Brief description of the Monarch Air Support Therapy and the Med-Pro Air Support System.
Reprint: Krouskop, T., et al., *The Effectiveness of Air Floatation Beds*, Case Science and Practice, Nov., 1984.
Advertisement: "Why Mediscus?", Mediscus Group literature advertising Mediscus' Air Support Therapy.
Advertisement: "The Mediscus Mark V-A Pressure Treatment System".

*Primary Examiner*—Eric K. Nicholson
*Attorney, Agent, or Firm*—Lyon & Lyon

[57] ABSTRACT

An air inflatable support appliance which may have internally sealed seams, internal diaphragms and internal structural support members is described. The appliance comprises gaseous mixture permeable, substantially solids and liquids impermeable cushions, used singly or in multiples with attachment to a source of pressurized and optionally heated gaseous mixture. The gaseous mixture flow may be independently controllable for each cushion. The appliance is portable and easily cleaned and is constructed so as not to require an external support frame or base.

10 Claims, 2 Drawing Sheets

FIG. 4.
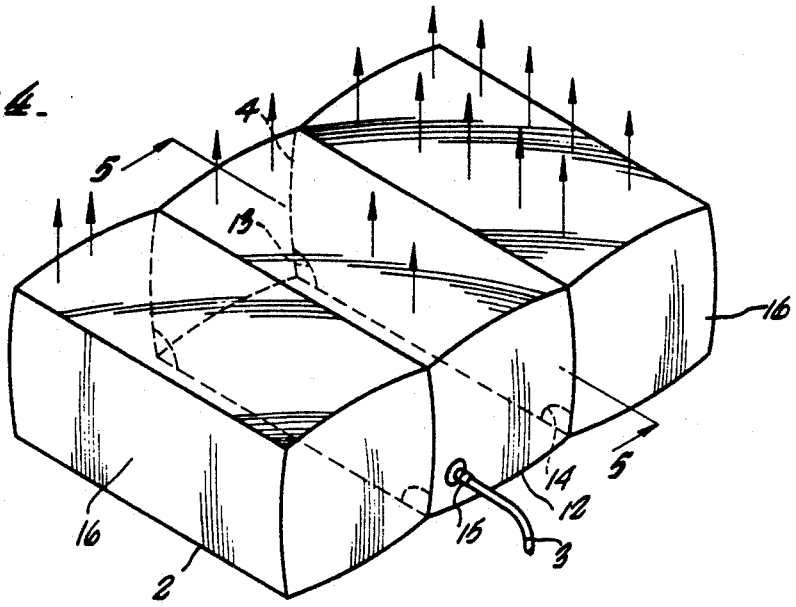
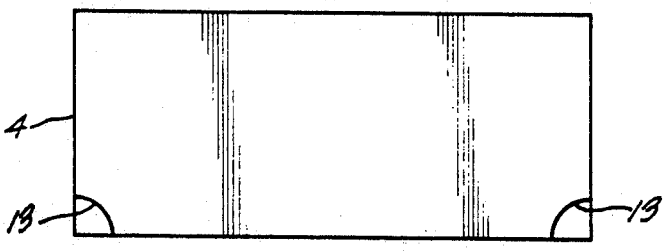
FIG. 5.
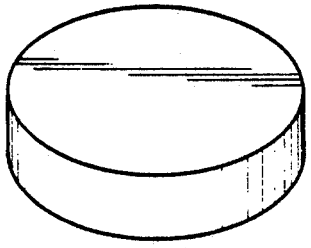
FIG. 1.
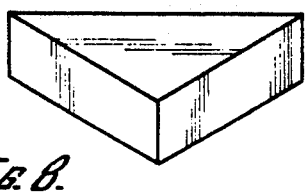
FIG. 8.
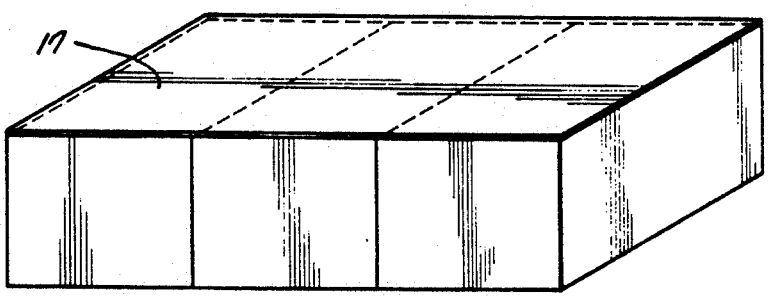
FIG. 6.

AIR SUPPORT CUSHION

This application is a continuation of application, Ser. No. 07/198,142, filed May 24, 1988, now abandoned.

BACKGROUND OF THE INVENTION

This invention relates to an inflatable support appliance and in particular to a portable, light-weight, easy to maintain and clean gaseous mixture inflatable support therapy cushion.

It has long been known that an unfortunate side effect of being compelled to lie relatively immobile due to injury or infirmity, is the manifestation of decubitus ulcers, known popularly as "bed sores", on the body dermis which experiences unrelieved contact with a firm surface. These ulcerations which serve to only further debilitate the prone patient, are caused by the combined effects of disrupted peripheral blood circulation and moisture accumulation at the sites of such firm body surface contact. The potential formation of decubitus ulcers requires that a patient, such as a hospital, out-patient or nursing home occupant, being unable to adjust his or her own posture without assistance, must be manually repositioned at frequent intervals around the clock for as long as such relative immobility persists.

Air beds have been used to support immobilized patients and several types of air support appliances are known. However, currently available air support appliances are cumbersome and expensive, requiring considerable ancillary apparatus such as a conventional bed frame, base boards, bellows and drawsheets. Mechanical and structural complexity, such as the incorporation of numerous conduit paths, header chambers, tubular members, plenum chambers and multiple layers of material between mattress and user, characterizes many of the air support systems previously known.

Experience with existing inflatable mattresses has revealed a number of shortcomings: they are difficult to transport, set up and maintain and are costly, there being a high purchase price for the support mattress and ancillary equipment. These and other drawbacks are believed to make air mattress use prohibative for many nursing homes, small hospitals and in home care. Moreover, no wide selection of sizes and shapes are available at a low cost with ease of set up and maintenance.

To the inventors' knowledge, there does not exist at this time any apparatus such as the present invention which alleviates the conditions causing bed sores or can treat a wide variety of dermal problems such as abrasions, burns, wounds or lacerations and thereby provide for general skin care and allows for individual air cushion pressure control, is available in a variety of shapes and sizes and yet remains extremely portable, easy to maintain and clean and removes the need for any external frame. As those in the field are aware, in the United States alone there are each year millions of potential users of such a support appliance. Several issued patents demonstrate the shortcomings of existing systems.

Scales U.S. Pat. No. 3,822,425 issued Jul. 9, 1974 is directed to an inflatable support appliance made of material that has water vapor permeability with limited air permeability, but is non-permeable to solids and liquids. As disclosed, Scales teaches the use of an external structural support such as a bed frame. The air cells have a two part (cap unit and trough) structure and have the claimed important feature of allowing for the permeability of water vapor from the outside to the inside of the air cell's surface. An outlet port to exhaust air from the system is also required.

Hunt et al, U.S. Pat. No. 4,488,322 issued Dec. 18, 1984 and its continuation, Hunt et al, U.S. Pat. No. 4,525,885 issued Jul. 2, 1985 both show an air support mattress containing a plurality of inflatable air sacs requiring an external supporting bed frame. The Hunt patents preferably require constructing the air sacs of air impermeable and water vapor permeable material.

SUMMARY OF THE INVENTION

The present invention is of a portable air support therapy bed consisting of, in a preferred embodiment one or more segmented, sealed cushions constructed of air permeable and substantially liquids and solids impermeable material. The invention may be constructed inexpensively and will be easy to operate. Multiple sizes and shapes of cushions are provided which allow adaptability of use from full adult sizes to child sizes to special shapes for a single portion of the body.

Each cushion is preferably constructed to provide user surface free of external seams or obstructions which could irritate the skin of the user. Of course, one seam, preferably a bottom seam will be externally sealed. In one preferred embodiment a multisegmented cushion is provided, each of two or more segments being separated by an internal diaphragm which is attached by attachment means to the internal sides of the top surface, bottom surface and at two different points on the side surfaces. The diaphragms would preferably be arranged transversely to the position of the user. In yet another preferred embodiment, structural support means (ribs) may be attached by attachment means onto at least the interior of the top surface of one or more cushions. These structural support means will be collapsible upon cushion deflation so that the embodiments having this feature will retain its portability. When multiple cushions are used each cushion is preferably detachably joined to its neighbor by suitable means such as by using attachment means made of strips, buckles or hook and loop tapes as non-limiting examples.

As will be appreciated by those skilled in the art, the arrangement and attachment of the diaphragms, support means and attachment means could be varied without departing from the scope of the invention.

In another embodiment, two or more cushions with independent pressure control would be integral with and share a common and contiguous upper surface comprising a single sheet of material with the already recited permeability characteristics. This embodiment would eliminate the gap or space between cushions and hence the need for a detachable attachment means. In this embodiment, contiguous cushions could share a common sidewall or bottom.

In the embodiment of the invention utilizing diaphragms, each internal diaphragm (the material which divides each cushion into segments) may have one or more internal cut-outs (openings) in the internal diaphragms so that a gaseous mixture such as air or one or more of the component gases making up air, will be able to freely pass between all of the segments. This feature also facilitates the easy internal flow of water through the cushions for cleaning purposes. None of the embodiments set forth require an outlet or exhaust port.

A feature of the invention is that no ancillary support system such as a headboard, footboard, baseboard or bed frame is required as either the pressurized gas flow alone and/or the use of structural support means will provide sufficient user support. The simplicity of the invention is further evidenced by the lack of any cover or drawsheet requirement on the top of a cushion. The inflatable cushions could be constructed with circular, triangular, cubic or rectangular or any other desired shapes depending upon the particular circumstances of use.

DESCRIPTION OF THE DRAWINGS

Various aspects and features of the present invention will now be described with reference to the accompanying drawing in which:

FIG. 4 is a perspective view of a preferred embodiment of a single tri-segment cushion with a partial cutaway showing the interior of the middle cushion segment.

FIG. 5 is a cross-sectional view of FIG. 4 taken along line 5—5.

FIG. 6 is a perspective view of a preferred embodiment where a plurality of cushions (three are shown) have a common and contiguous top sheet integral with the side walls of each such cushion.

FIG. 7 is a perspective view of a single cushion in an arcuate shape.

FIG. 8 is a perspective view of a single cushion in a triangular shape.

DETAILED DESCRIPTION OF THE PREFERRED EMBODIMENTS

Figure 1:
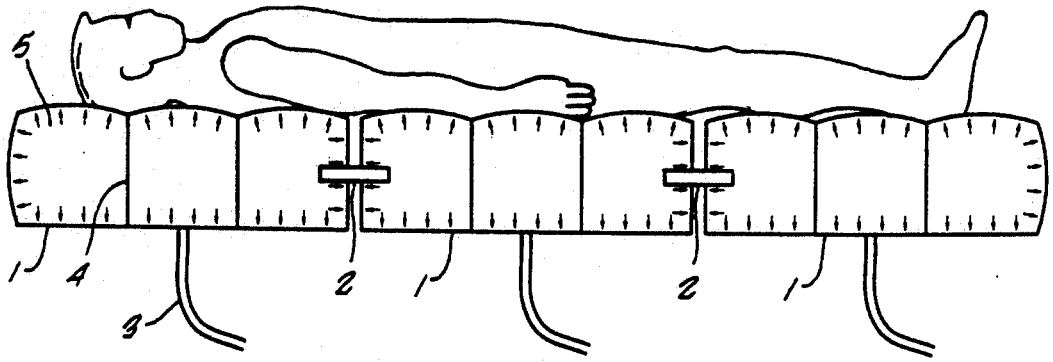
FIG. 1 is a side elevation view of a preferred embodiment of the invention whereby three inflatable support cushions are joined together with accompanying gaseous mixture hoses and a fully prone user is illustrated.

Referring to the drawings;

FIG. 1 shows a side elevation view of three fully inflated cushions 1, with midline detachable attachment means 2, which may be buckles, clasps, hook and loop tapes or any other suitable device to hold the cushions in contact with adjoining cushions when multiple cushions are used. One type of attachment means would be straps with hook and loop surfaces such as sold under the VELCRO trademark. Air hoses 3 are preferably centrally connected to each cushion 1. Such attachment means 2 are preferably easily detached to enable the cleaning and storage of each cushion separately.

However, the connection point could be varied along the side or bottom of the cushion without departing from the scope of the invention.

The figure reveals several important features of the present invention including the lack of any need for a cover or drawsheet between the user and the cushion surface. No such intermediary layer is required because, as illustrated, the appliance preferably has no recesses, groves or slots wherein fluids or particulate matter could accumulate. The embodiment utilizing structural support means (ribs) will likewise not create depressions where liquids or solids could accumulate.

Figure 2:
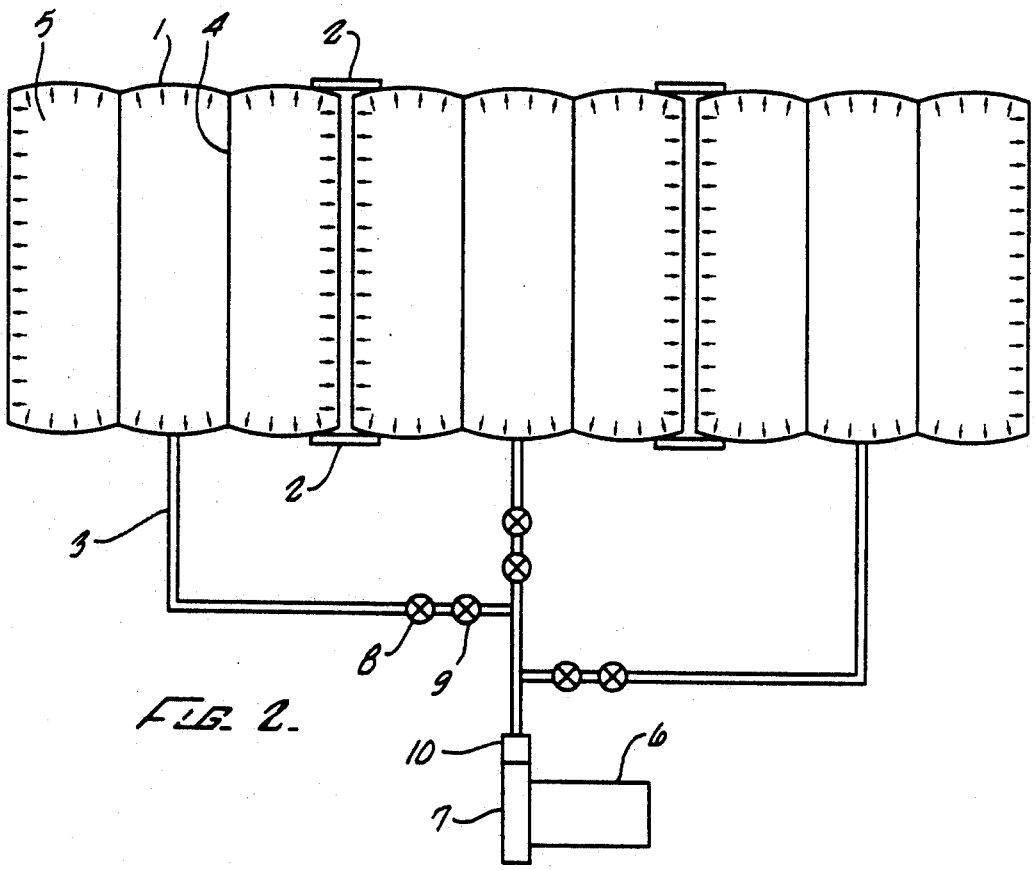
FIG. 2 is a top plan view of a preferred embodiment showing three joined cushions, with ancillary gaseous mixture hoses, valves, electric motor and blower.

Referring to FIG. 2, in a preferred embodiment, there would be diaphragms 4 separating each cushion into, for example, three segments 5. However, the scope of the invention is not limited by the number of internal segments. The diaphragms 4, serve to restrain the expansion of the cushions when fully inflated and only slightly deform the cushion surface upon inflation when the, preferably three, cushion segments are fully defined. Each diaphragm would preferably be continuously attached (except for cutouts discussed below) by attachment means to the internal sides of the top surface, bottom surface and at two different points on the side surfaces of said cushion to thereby define a segment. The shape and number of segments may vary depending on user choice and the shape (e.g. circular, triangular, rectangular) of the cushion (See FIGS. 7 and 8).

In FIGS. 1 and 2, a space between cushions is shown only to illustrate the position of the midline cushion attachment means 2 which will hold the cushions 1 firmly in contact with each adjoining cushion when multiple cushions are in use. More than one attachment means 2 may be used without departing from the scope of the invention.

Figure 3:
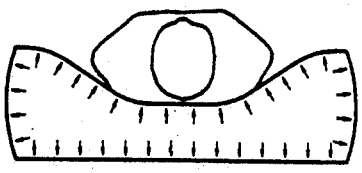
FIG. 3 is an end elevation view.

Small arrows internal to each segment in the Figures illustrate inflation without undue deformation while supporting the weight of a user as indicated in FIG. 3.

The top plain view of FIG. 2 shows the additional features of a motor 6, blower 7, gaseous mixture pressure gauge 8 and an adjustable valve 9, to control the gaseous mixture pressure in each cushion. Although any suitable gas pressure generator system (6 and 7) that can generate from about 0.3 centimeter to about 40 centimeters (about 0.1 inches to about 16 inches) of water pressure and a gaseous mixture flows of from about 30 liters to about 3,000 liters per minute (about 1 cubic foot to about 100 cubic feet per minute) and pressure indicator and flow control means (8 and 9) are within the scope of the invention, preferably the gaseous mixture will be provided by a generator which can provide a flow of from about 900 liters to about 1,200 liters per minute (about 30 to 45 cubic feet per minute) of a gaseous mixture at a pressure of from about 0.3 centimeter to about 30 centimeters (about 0.1 inches to about 12 inches) of water.

In use each cushion will preferably be attached by way of an air hose to a motor 6 equipped with a blower 7 which will send a flow of a pressurized gaseous mixture (selected from the group consisting of air or a mixture of one or more of the constituent gases making up air or combinations thereof) into the cavity of each cushion by way of a gaseous inlet means (15 on FIG. 4) which penetrates either a side or bottom surface of each cushion. In one embodiment of the invention a suitable gaseous mixture heater and temperature control mechanism (not shown) can be inserted in the air flow system either before or after the gaseous pressure generator. A heater element constructed for example of several coils of high resistance wiring is shown as 10 in FIG. 2. Multiple cushions can be served by a single motor-blower arrangement, each hose to each cushion having separately adjustable pressure valves 9.

The cushions are preferably to be constructed of a material (i.e. woven, plastic, natural or synthetic) which will provide 1) a smooth, essentially obstruction-free surface (at least in the area of user contact); 2) is amenable to internal sealing or joining such as by (non-limiting examples) stitching (so that each side surface of each cushion is attached continuously along the periphery of both the top and bottom surface) bonding, laminating, coating, glueing, electric or dielectric sealing and the positioning of an internal collapsible support members and; 3) has the characteristics (at least in the area of user contact) of relatively high permeability to a gaseous mixture such as air and substantial impermeability to solids and liquids. Air or gas permeability allows a user to be warmed or cooled by the gas flow and reduces the accumulation of moisture, an important factor in the occurrence of bed sores. High (that is substantial) gaseous mixture permeability of at least the cushion material surface in contact with a user, is an important feature of the invention, allowing the user to be ventilated and obviating the need for any gaseous mixture outlet or exhaust means.

Such suitable materials are well known to those skilled in the art including those constructed of various plastics, synthetics (such as that sold under the trademark GORTEX), and woven materials. In particular, the desired permeability characteristics can be provided by any material with pores of a suitable microscopic aperture which will allow a gaseous mixture (such as for example air) to pass from the inside to the outside of each cushion and which will render the cushion material substantially impermeable to the passage of solids and liquids in either direction. One such acceptable material which is believed to have the recited characteristics is polyurethane coated nylon stitched with a hot needle or with a heat sealing compound applied to the stitched area to reduce air permeability through the holes made by stitching.

Because the molecular diameters of single molecules of oxygen, nitrogen and water are respectively about 3 Angstroms, 3.3 Angstroms and 1.5 Angstroms (one Angstrom is $10^{-8}$ centimeters) pore diameters of upwards from about 4 Angstroms should provide the desired gas permeability. The cushion material in the preferred embodiment, it is expected, will have the desired substantial liquids and solids impermeability characteristics and the desired substantial gaseous mixture permeability characteristic by having pore diameters ranging from about 4 Angstroms to about 200 microns. In particular pore sizes of from about 0.5 micron to about 10 microns are preferred.

The gaseous mixture pressure in each cushion will preferably be adjusted so as to provide an even and comfortable distribution of the weight of the person reclining or lying on one or more of the cushions. In this manner the pressure points which come into existence, at various places on the human body upon assuming a prone position, will be much attenuated. In practice it is believed that the practice of rotating a patient to prevent bed sores would therefore not be required. Applications to hospital care (i.e.: burn patients) and nursing homes are anticipated. The invention can also conveniently be used at home on an out-patient basis and for domestic and consumer purchasers desiring the beneficial advantages obtained from use of the invention. Portability of the invention means that in conjunction with, for example, a standard 12 volt battery and a booster and converter to 120 volts AC, to power the gaseous mixture generator, the invention could as non-limiting examples be conveniently used at remote locations such as in tents, vans, ambulances by the military and at accident sites. The motor need not be electrically driven. As well the gaseous mixture for inflation could be supplied by any convenient source of compressed gas, such as stored in gas cylinders.

The decreasing of pressure points and establishment of an equilibrium between the cushion surfaces and the weight of the user is accomplished by adjusting the gaseous mixture pressure in each cushion to match the weight of the body portion resting upon the surface of that cushion.

Being preferably constructed of gaseous mixture permeable and substantially liquid impermeable material, a flow of the gaseous mixture will be emitted from the surfaces of each cushion. In this manner the desired gas pressure/weight distribution can be maintained and the accumulation of moisture reduced.

As FIG. 2 indicates, one embodiment of the invention would have an air pressure gauge and an adjustable air valve for each cushion. Thus when multiple cushions are used, it is envisaged that each cushion when inflated will, for a popular cushion size, have a top surface of about two to two and one-half feet in the direction parallel to the user so that preferably three connected cushions would provide support for the full length of most fully reclining adult users. Of course, there is no restriction on the number of cushions that may be used. For example, one cushion alone could find application to support a limb or leg or for other partial body weight support. Indeed, the Inventor believes that infants and even newborns afflicted by conditions making firm body-surface contact undesirable (i.e.: spina bifida) may benefit from a period of use of this invention. It is believed that different embodiments of the invention could support from a few kilograms to about 250 kilograms of weight. The beneficial effects of artificial support through use of the present inflatable air cushion is therefore not to be construed to be limited to adult users. Similarly, as will be apparent to those skilled in the art, different cushion shapes could be used for specific applications.

One of the considerable advantages of the invention is in its exceptional adaptability and portability. Cushions may be constructed in an infinite range of sizes and shapes, without the need for any external frame such as a traditional bed frame, headboard, baseboard or footboard. The cushion could be constructed in a variety of shapes such as for example circular, triangular, cubic, rectangular or with even more sides. The circumstances of use such as user size (i.e., infant, adolescent, adult), number of users and relative desired posture positionings as well as possible economic factors dictate the particular shape and size most suitable.

FIG. 3 is an end elevation view showing in exaggerated form the deformation of the anterior most cushion under the weight of a fully prone adult user, when the gaseous mixture pressure is kept at a relatively low level. It is important in use that as large a surface area of the cushion top as possible contact the user so that pressure at any one point is minimized. In use, the pressure of air to each cushion may be varied as required by the needs of the user. Lowering the gaseous mixture pressure might also prove advantageous so as to passively restrain a user in the trough or well so created. In effect, the user is prevented from injury or possible intravenous tubing dislocation by the gently sloping walls, such slope being greater the lower the air pressure is set.

FIG. 4, a perspective view of a single cushion, shows a diaphragm 4 of the central cushion section 12 through the partial cutaway feature of FIG. 4. FIG. 5 is a detail of a diaphragm 4. Cutouts 13 and 14 of the diaphragm defining the central cushion section 12 allow the gaseous mixture and liquids to freely pass to the two adjoining cushion segments or sections. These cutouts would preferably be positioned along the borders of the diaphragm although such location is not essential to their function. Permeability of the top surface of a cushion to the gaseous mixture is indicated by the arrows emanating from the top surface of the cushion.

A gas inlet port (one for each cushion) is shown at 15 as an example of a gaseous mixture inlet means. The gaseous mixture inlet means preferably is located on a side or bottom surface of each sealed cushion, penetrates the cushion material, is sealed around its perimeter at the area of penetration and is sealably connected to the hose 3. In use, the inlet port functions both to allow the gaseous mixture to enter and, upon deflation, to allow cleansing solution to enter and exit the cushion. The construction of the inlet means is not critical to the invention and any suitable inlet means is within the scope of the invention.

In a third embodiment there will be internal structural support means 16 which may be called ribs, attached by attachment means to at least the top interior surface of the cushion material and preferably to the top and bottom interior surfaces. The cushion will collapse when deflated because the structural support members and cushion material are flexible. These ribs taken together form the internal skeleton or support structure of the cushions.

The internal structural support means of this embodiment of the invention can be constructed of many forms of resilient, yet flexible materials which are amenable to being internally attached to the inner air cushion fabric surface in such a manner as not to create pressure points on the user when the cushion is in use. Plastic strips, flexible metal bands and wire embedded plastic are non-limiting examples of such suitable internal structural support member materials.

FIG. 6 shows another preferred embodiment of the invention. Here a common and contiguous top sheet 17 with the previously recited permeability/impermeability characteristics, forms the user contact surface and joins a plurality of cushions 1 (preferably three), together without any intervening gap or space between cushions. This single sheet of top surface material 17, when this embodiment of the invention is in use, will be attached by attachment means (such as internal stitches or heat bonded sealing) so as to be integral with all cushion side walls. In this manner each cushion will retain separate and separately controllable gaseous mixture compartments but will not have any gaps between adjoining top edges of the cushions. Preferably only this single sheet of top surface material 17 will have the permeability characteristics previously recited, thereby reducing the expense of construction of the appliance. This embodiment of the invention could also have the features such as internal diaphragms or structural support means of one or more of the previously described embodiments. It is also within the scope of the invention, for the cushions to share one or more common sidewalls where the cushions adjoin each other and to have a common bottom.

The present invention also relates to a method for supporting at least partially the weight of a user on at least one gaseous mixture inflatable cushion 1. This method comprises the steps of generating a flow of a pressurized gaseous mixture, connecting said gaseous mixture flow to the inlet port 15 of at least one cushion (i.e.: one or more cushions may be used, joined together, at the same time) thereby inflating the cushion or cushions and then adjusting and controlling the gaseous mixture flow. In one preferred embodiment of this method the gaseous mixture will be air and have temperature control. The inflatable cushions may be internally segmented and constructed of the same material previously described. Internal stitching of the diaphragms which divide the internal segments and the cushion material is used in a preferred embodiment of this method. Another preferred embodiment would have internally stitched structural support members as previously described. No gaseous mixture outlet means such as an air flow outlet port will be required for any of these suggested embodiments.

As will be appreciated by those skilled in the art alterations or modifications could be made to this invention without departing from its scope. The Inventor does not wish or intend to limit the scope of his invention to the three embodiments described and illustrated. The breadth of this invention is intended to be determined by the appended claims and their equivalents.

I claim:

1. A lightweight and portable support alliance comprising:

a) at least one cushion having a top surface, a bottom surface and at least one side surface attached continuously along the periphery of both the top and bottom surface to form an impermeable seal, the cushion having at least one internal segment formed by at least one internal diaphragm, which internal diaphragm provides a flexible support to prevent cushion deformation caused by inflation and which also allows the cushion to be collapsed to a substantially flat configuration when deflated, the internal diaphragm attached by attachment means to the internal sides of the top surface, bottom surface and at two different points on the side surfaces of the cushion, wherein the attachment means consists essentially of internal stitching such that the top surface and edges thereof are free of external seams and obstructions to eliminate sources for ulcers or the like on the user's body, at least one internal diaphragm having at least one opening through which the gaseous mixture can freely pass and in which liquids also can freely pass to facilitate cleaning of the support apparatus;

b) at least the top surface of the cushion being formed from a material bearing microscopic apertures, wherein the apertures are less than about 10.0 microns and greater than about 4 Angstroms, allowing substantial permeability to the gaseous mixture and rendering the material substantially impermeable to solids and liquids to provide an ulcer-free air flow microenvironment for the user while simultaneously eliminating the need for a separate gaseous mixture outlet or exhaust port, wherein also at least the top surface of each cushion is formed of a single contiguous sheet of the material bearing microscopic apertures, which sheet is attached by attachment means so as to be integral with the cushion side walls and which joins one or more cushions without intervening gaps or spaces between cushions which could cause ulcers or the like on the user's body or liquids or solids to penetrate there between;

c) a means for gaseous mixture inlet penetrating either one of the side surfaces or the bottom surface of the cushion, the inlet means being sealed around its periphery at the point of cushion penetration; and d) a means, sealably connected to the gaseous mixture inlet means, for generating a pressurized flow of a gaseous mixture to the cushion, having the capacity to produce from about 30 liters to about 3,000 liters per minute of the gaseous mixture to the cushion at a pressure of from about 0.3 centimeters to about 40 centimeters of water thereby inflating the cushion to form a flexible, ulcer free support for at least a portion of the body of the user without the need for an ancillary external support structure, wherein said pressurized flow means comprises:

1. a motor;
2. a blower attachment connected to the motor; and
3. a valve, sealably connected to the inlet means provided for the cushion.

2. The support appliance according to claim 1 wherein the cushion comprises a plurality of internal segments formed by at least one internal diaphragm.

3. The support appliance according to claim 1 wherein the cushion has one side surface and top and bottom surfaces substantially arcuate in shape, or three side surfaces and top and bottom surface substantially triangular in shape, or four side surfaces and top and bottom surfaces substantially rectangular in shape.

4. The support appliance according to claim 1 wherein the microscopic apertures have diameters of from about 4 Angstroms to about 0.5 microns in the top surface material of the cushion.

5. The support appliance according to claim 1 wherein a detachable attachment means holds more than one cushion together in the support appliance.

6. The support appliance according to claim 5 wherein the detachable attachment means is selected from the group consisting of buckles, clasps and hook and loop tapes.

7. The support appliance of claim 1 wherein the diaphragm is arranged transversely to the position taken by the user when the appliance is in use.

8. The support appliance of claim 1 wherein the cushion comprises a plurality of internal segments formed by at least one internal diaphragm, and wherein the cushion has one side surface and top and bottom surfaces substantially arcuate in shape or three side surfaces and top and bottom surfaces substantially triangular in shape or four side surfaces and top and bottom surfaces substantially rectangular in shape, and wherein the diaphragms are arranged transversely to the position taken by the user when the appliance is in use.

9. A lightweight and portable support appliance comprising:

a) at least one cushion having a top surface, a bottom surface and at least one side surface attached continuously along the periphery of both the top and bottom surface to form an impermeable seal, the cushion having one side surface and top and bottom surfaces substantially arcuate in shape or three side surfaces and top and bottom surfaces substantially triangular in shape or four side surfaces and top and bottom surfaces substantially rectangular in shape, the cushion having a plurality of internal segments formed by at least one internal diaphragm arranged transversely to the position taken by the user when the appliance is in use, which internal diaphragm provides a flexible support to prevent cushion deformation caused by inflation and which also allows the cushion to be collapsed to a substantially flat configuration when deflated, the internal diaphragm attached by attachment means to the internal sides of the top surface, bottom surface and at two different points on the side surfaces of the cushion, wherein the attachment means consists essentially of internal stitching such that the top surface and edges thereof are free of external seams and obstructions to eliminate sources for ulcers or the like on the user's body, at least one internal diaphragm having at least one opening through which the gaseous mixture can freely pass and in which liquids also can freely pass to facilitate cleaning of the support apparatus;

b) at least the top surface of the cushion being formed from a material bearing microscopic apertures, wherein the apertures are about 4 Angstroms to about 0.5 microns allowing substantial permeability to the gaseous mixture and rendering the material substantially impermeable to solids and liquids to provide an ulcer-free air flow environment for the user while simultaneously eliminating the need for a separate gaseous mixture outlet or exhaust port, wherein also at least the top surface of each cushion is formed of a single contiguous sheet of the material bearing microscopic apertures, which sheet is attached by attachment means so as to be integral with the cushion side walls and which joins one or more cushions without intervening gaps or spaces between cushions which could cause ulcers or the like on the user's body or liquids or solids to penetrate there between;

c) a means for gaseous mixture inlet penetrating either one of the side surfaces or the bottom surface of the cushion, the inlet means being sealed around its periphery at the point of cushion penetration; and d) a means, sealably connected to the gaseous mixture inlet means, for generating a pressurized flow of a gaseous mixture to the cushion, having the capacity to produce from about 900 liters to about 1,200 liters per minute of the gaseous mixture to the cushion at a pressure of from about 0.3 centimeters to about 30 centimeters of water thereby inflating the sealed cushion to form a flexible, ulcer free support for at least a portion of the body of the user without the need for an ancillary external support structure, wherein said pressurized flow means comprises:

1. a motor;
2. a blower attachment connected to the motor; and
3. a valve, sealably connected to the inlet means provided for the cushion.

10. A method of supporting at least partially the weight of a user on the portable support appliance of claim 1 without the assistance of ancillary external support structures comprising:

a) generating a flow of a pressurized gaseous mixture without the assistance of a complicated mechanical or electrical gas generating apparatus;

b) connecting the gaseous mixture flow to the gaseous mixture inlet means of at least one sealed cushion having a top surface, a bottom surface and at least one side surface, the top surface of the cushion being formed from a material bearing microscopic apertures which materials is permeable to the gaseous mixture and substantially impermeable to solids and liquids, wherein the microscopic apertures are less than about 10.0 microns and greater than about 4 Angstroms, the cushion also having at least one internal segment formed by at least one internal diaphragm, the internal diaphragm providing a flexible support to prevent cushion deformation caused by the user's body weight and collapsibly attached by attachment means to the internal sides of the top surface, bottom surface and at two different points on the side surfaces of the cushion to define a segment, the cushion being sealed by internal stitching and the internal diaphragm attached to the cushion material by internal stitching, the internal stitching rendering the top surface and the edges thereof essentially free of external seams and obstructions, and at least one internal diaphragm having at least one opening through which said gaseous mixture can flow and liquids can pass to facilitate cleaning;

c) inflating each said cushion to bear at least a portion of the user's body without cushion deformation; and d) adjusting and controlling said gaseous mixture flow and pressure independently for at least one cushion to support the user in a selected position.

* * * * *